United States Patent [19]

Evens

[11] Patent Number: 4,906,334

[45] Date of Patent: Mar. 6, 1990

[54] BROKE PULPING APPARATUS AND REEL STAND WITH BRAKE

[75] Inventor: David A. Evens, Duluth, Minn.

[73] Assignee: Lake Superior Paper Industries, Duluth, Minn.

[21] Appl. No.: 329,305

[22] Filed: Mar. 27, 1989

[51] Int. Cl.[4] ..... D21F 1/66; B65H 23/06

[52] U.S. Cl. ..... 162/264; 162/191; 242/68.4; 242/75.4

[58] Field of Search ..... 242/55, 55.2, 68.4, 242/75.4; 162/264, 191, 255

[56] References Cited

U.S. PATENT DOCUMENTS

| | | | |
|---|---|---|---|
| 1,692,112 | 11/1928 | Cram | 162/191 |
| 1,875,153 | 8/1932 | Richter | 242/75.4 |
| 2,631,790 | 3/1953 | Wheldon | 242/75.4 |
| 2,667,106 | 1/1954 | Hyman et al. | 162/255 |
| 3,011,733 | 12/1961 | Ford | 162/264 |
| 3,036,787 | 5/1962 | Triquet | 242/75.4 |
| 3,120,930 | 2/1964 | Forman | 242/75.4 |
| 3,127,125 | 3/1964 | Jilbert | 242/75.4 |
| 3,236,723 | 2/1966 | Whiteside | 162/264 |
| 3,245,868 | 4/1966 | Espenmiller et al. | 162/264 |
| 3,660,226 | 5/1972 | McKeown | 162/264 |
| 3,770,579 | 11/1973 | Cline | 162/264 |
| 3,915,264 | 10/1975 | Ohi | 242/75.4 |
| 4,214,943 | 7/1980 | Stern | 242/75.4 |
| 4,242,173 | 12/1980 | Stenemann | 156/523 |
| 4,447,012 | 5/1984 | Woodruff | 242/75.4 |

FOREIGN PATENT DOCUMENTS

| | | | |
|---|---|---|---|
| 871510 | 5/1971 | Canada | 162/264 |

*Primary Examiner*—Karen M. Hastings

*Attorney, Agent, or Firm*—Haugen and Nikolai

[57] ABSTRACT

The invention comprises a broke pulping system including a pulper tank and a reel stand located above the pulper tank. The reel stand further comprises apparatus for cradling a reel of paper on a mandrel for rotation about a horizontal axis, and apparatus for braking in order to control the rotation. The reel stand further includes a hold and the braking apparatus cooperates with the mandrel so as to cause the reel to rotate, unwind and fall through the opening into the pulper tank when the brake is released after the reel is slit across its width direction. When the brake is applied, the reel will stop rotating. The broke pulping system of the invention will preferably include an enclosure apparatus for preventing people or other objects from accidentally falling through the opening in the reel stand. In an alternate embodiment of the invention paper may be sampled from reels in a more efficient manner than the prior art allows by removing an outer layer or slab from the reel, collecting a sample and sending the remaining paper on the reel to further finishing operations.

7 Claims, 2 Drawing Sheets

BROKE PULPING APPARATUS AND REEL STAND WITH BRAKE

BACKGROUND OF THE INVENTION

The invention is directed to a system for handling and reclaiming paper and, more particularly, to a broke pulping system including a reel stand located above a pulper tank for reclamation of unusable paper commonly referred to in the industry as "broke".

In the paper making industry, it can happen that a run of paper put on a reel will be defective. This defective paper is referred to as a "broke". Rather than merely burning or discarding the defective paper, it is common in the industry to reprocess it. Specifically, the broke will be deposited in a pulper where it is mixed with water and agitated until it can be again converted into paper. One prior art method for reprocessing broke comprises the labor intensive practice of removing broke from a reel known as "slabbing", by merely cutting it through, a layer at a time, with a utility knife and allowing it to fall on a factory floor. A forklift would then be used to transport the slabbed broke to a pulper. The broke would be deposited into the pulper for repulping. Repulping is done in a device called a pulper, which effectively reduces the paper to a mixture of water and fiber through intense agitation and water addition. Pulpers are commercially available devices and one such machine forms a part of the broke pulping system described herein. Slabbing operations, as described above, tend to interfere with normal production processes at the existing pulpers, which are usually intended for other purposes, causing further reduction in overall mill efficiency.

SUMMARY OF THE INVENTION

The invention comprises a broke pulping system including in one embodiment a pulper tank and a reel stand located above the pulper tank. The reel stand further comprises means for cradling a reel of paper on a mandrel, usually a reel spool, for rotation about a horizontal axis, and means for braking which controls the rotation. The reel stand further includes a hole in the floor and the braking means cooperates with the mandrel so as to cause the reel to rotate, allowing the paper to unwind and fall through the opening into the pulper tank when the brake is released after the reel is slit with a knife across its width direction. When the brake is applied, the reel will stop rotating to make ready for the next slitting operating. The broke pulping system of the invention will preferably include an enclosure means for preventing people or other objects from accidentally falling through the floor opening within the reel stand into the pulper below.

In an alternate embodiment of the invention paper may be sampled from reels in a more efficient manner than the prior art allows by removing an outer layer, or slab, from the reel depositing it into the pulper collecting a sample, and then sending the remaining paper on the reel to further finishing operations.

It is the primary object of the invention to provide a broke pulping system consisting of a support frame assembly to accept and position paper machine reels of all diameters above an opening in the operating floor above a pulper tank.

It is yet another object of the invention to provide a system for facilitating the sampling of paper from reels in a more efficient manner.

It is yet another object of the invention to provide a broke reclamation system which does not require continuous operator attention wherein the operator slits one slab and allows paper to begin unreeling from the reel into the repulper without reapplying a brake thereby unwinding the paper through the opening in the floor. The paper is thus drawn into the repulper by its normal pulping action and thus the reel continues to unwind while the operator is free to attend other duties. In another embodiment, a drive motor may be employed to speed up the unwinding process.

Other features, objects and advantages of the invention will become apparent to those skilled in the art through the description of the preferred embodiment, claims and drawings herein wherein like numerals refer to like elements.

DESCRIPTION OF THE PREFERRED EMBODIMENT

Figure 1:
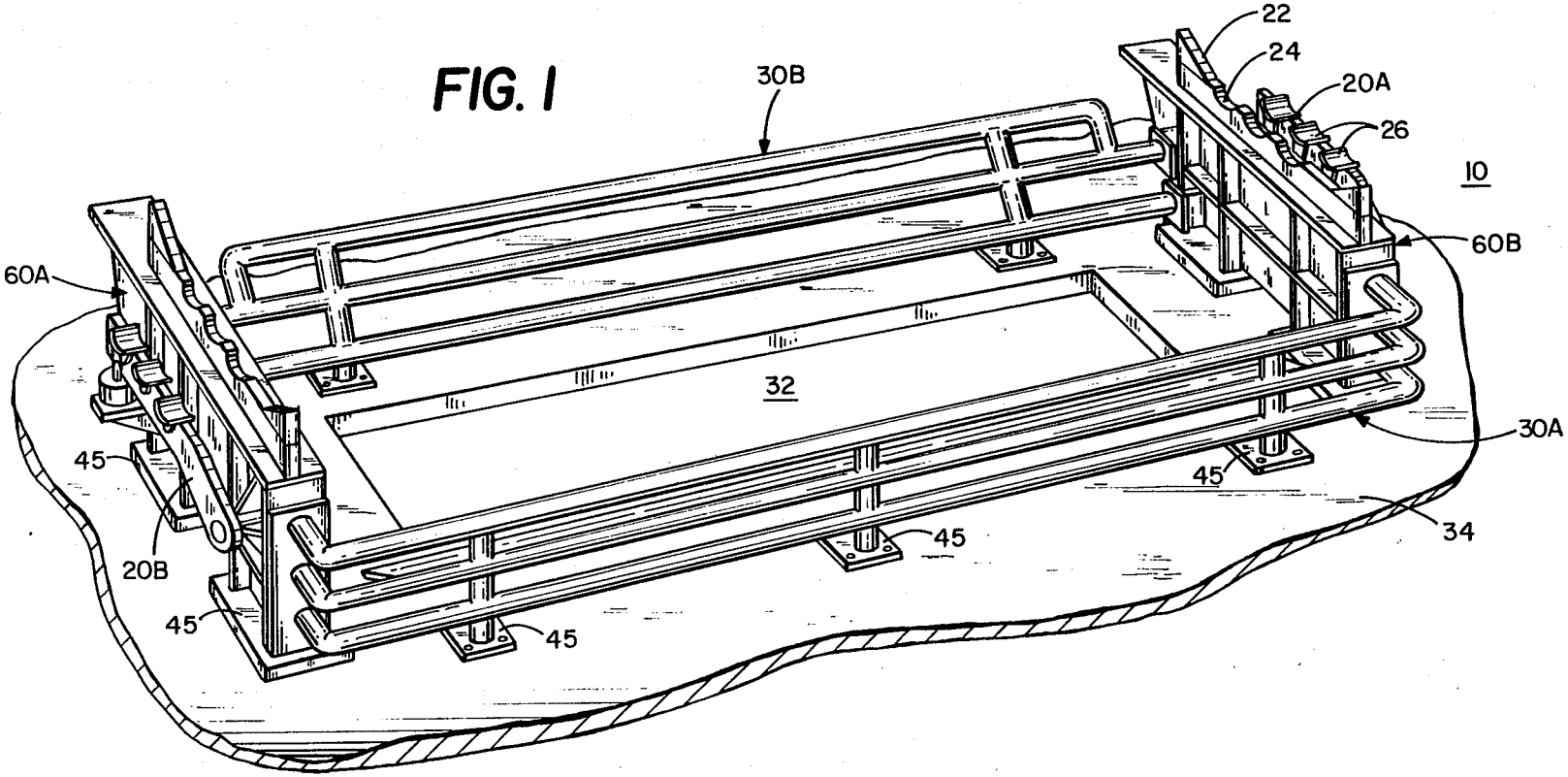
FIG. 1 shows an isometric view of one embodiment of the reel stand of the invention.

Referring now to FIG. 1, one embodiment of the reel stand 10, also called a support frame, of the invention is shown. The reel stand assembly shown comprises an enclosure means such as guard rails 30A and 30B attached to a frame having two members 60A and 60B disposed at opposite ends of the reel stand in a parallel relationship. In the preferred embodiment of the invention, the frame members and guard rails are further bolted to a base, in a typical case the base being the factory floor 34 by any well-known mounting means such as screws, bolts or the like through mounting plates designated generally as elements 45. Each frame member 60A and 60B further comprises a cradle 22 having a plurality of cusps 24 suitable for accepting and holding a reel of paper wound around a mandrel.

Figure 2:
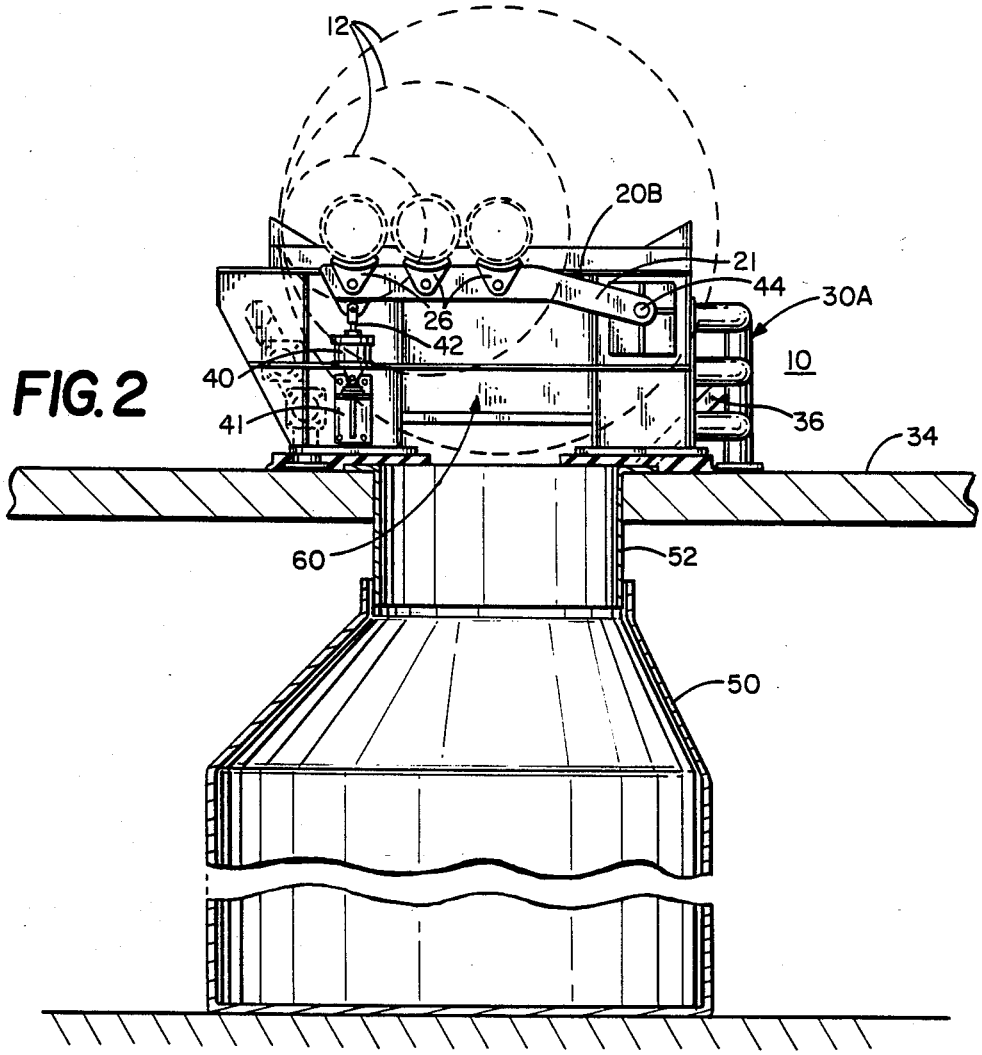
FIG. 2 is a side view showing schematically the reel stand and pulper system of one embodiment of the invention.

As is best shown in FIG. 2, the cusps are arranged to adaptively support reels of paper 12 of varying diameters as shown by the dotted lines in FIG. 2. While the embodiment shown in the figures features three cusps 24, those skilled in the art will recognize that almost any number of cusps can be employed depending on the variations in reel sizes which one desires to accommodate.

Still referring to FIG. 2, the reel stand also includes a brake 20 having a brake arm 21 and a brake piston 40. In the preferred embodiment of the invention, two such brakes are employed and are disposed on each frame member so as to enable the brakes to engage or disengage the mandrel being supported by the frame. Those skilled in the art will recognize, however, that it is possible to operate the device using only one brake, acknowledging that more time will be required to stop the reel. The brake arm 21 further comprises a pivot pin 44, a plurality of brake shoes 26, a piston rod 42 and a piston 40. Referring to FIG. 1, the brakes 20A and 20B are preferably mounted on the frame members 60A and 60B with a pivot pin 44, shown at FIG. 2, at one end of the brake arm pivotally attaching the brake arm 21 to the frame member. The brake shoes 26 are disposed such that they align with the cusps on the carriage member when the brake is applied by activating piston 40. Rod 42 pivotally attaches to the brake arm and may be integrally a part of the brake piston. In one embodiment of the invention, a ten inch diameter pneumatic cylinder was employed as the activation means for the brake. Those skilled in the art will recognize that any equivalent type of cylinder and piston arrangement could have been used whether liquid activated such as pneumatic or hydraulic, or mechanically activated or the like. In one embodiment of the invention, the brake piston 40 was mounted on a base 41 which, in turn, was mounted to the side of the frame 60 by means of metal bolts.

Figure 3:
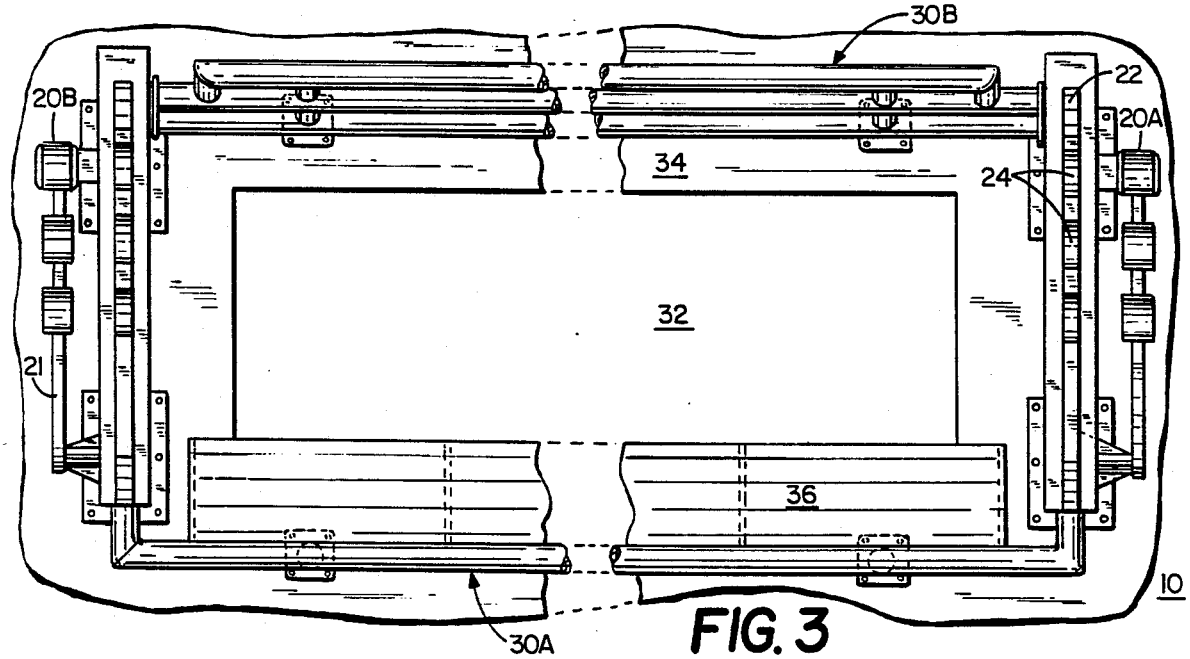
FIG. 3 is a top view of one embodiment of the reel stand of the invention.

Referring to FIGS. 2 and 3, the rest of the broke pulping system will now be described. As shown in FIGS. 2 and 3, the reel stand 10 includes a floor opening 32 which will allow paper to be deposited into pulper 50. Slanted guide plate 36 guides paper into the floor opening as the reel unwinds. The action of the pulper will continue to draw the paper into the pulping system once the reel begins to unwind if the brake is not reapplied. The pulper 50 may be any type of pulping system which is well known in the art. In the embodiment shown, three positions are available on the support frame assembly to enable reels of varying sizes to be placed close enough to the operator for ease in the slitting operation. Heavy guard rails 30A and 30B are provided to prevent the operator or equipment from accidentally falling into the floor opening. Of course, if safety were not a factor, the guard rails would not be essential to the operation of the invention.

Having described the structure of the preferred embodiment, the operation of the invention will now be explained in order to enhance understanding of the invention. Referring now to FIG. 2, in operation, if repulping of broke was the objective of the system, an operator would mount a reel of paper 12 on the carriage of the reel stand. The operator would immediately engage the brake system to prevent rotation of the mandrel. The reel of paper would be slit longitudinally as by an operator slitting the reel of paper with a utility knife. After the slitting the tail of the paper slab will fall and hang vertically over the opening 32. The operator can then release the brake which would allow the now unbalanced reel to rotate thus depositing the slab into the opening in the floor. The opening in the floor is connected to the pulper located directly below, via a metal chute 52. The slab is then conducted into the pulper where it is reduced to pulp under automatic control as is well known in the art. The operator can stop the reel from unwinding at any time by reapplying the brake.

The invention can also be used in broke reclamation in a manner not requiring continuous operator attention. In this mode, the operator would slit one slab from the reel as indicated, however, once the brake is released, it would not be reapplied, and the reel would continue to rotate, thereby unwinding the paper through the opening in the floor. The paper is drawn into the repulper by its normal pulping action and thus the reel to continues to unwind while the operator is free to attend other duties.

In other operations, the invention may be used for sampling for quality control purposes which involves removing an outer layer (or slab) from the reel, collecting a sample and sending the remaining paper on the reel to further finishing operations. Prior to the availability of the invention, sampling would be accomplished by removing the outer slab of paper and dropping it on the floor while the reel was hanging on a house crane. The slab would then be manually picked up and transported to a pulper. Having the benefit of the invention, the entire sampling operation can now be done with the reel placed in the cradle where the outer slab may be disposed of into the broke pulper as described above.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without department from the scope of the invention itself.

What is claimed is:

1. A broke pulping system comprising:

a pulper tank;

a reel stand located above the pulper tank wherein the reel stand further comprises means for cradling a reel of paper on a mandrel for rotation about a horizontal axis, means for braking, and means defining an opening, wherein the braking means cooperates with the mandrel and is structured and arranged to cause the reel of paper to rotate and unwind paper through the opening into the pulper tank when the reel of paper is slit across its width direction and the brake is released and to force the reel of paper to stop rotating when the brake is applied; and wherein the cradling means comprises a first plurality of cusps structured and arranged to accommodate paper reels of varying sizes and the braking means comprises a plurality of brake shoes on a brake arm pivotally attached to the reel stand with each brake shoe corresponding to a cusp and with a brake piston disposed to apply each brake shoe to a corresponding mandrel.

2. An apparatus for providing samples of paper from a reel on a mandrel comprising a reel stand further comprising means for cradling the reel for rotation about a horizontal axis, and means for braking wherein the braking means cooperates with the mandrel so as to provide a controlled release of any desired amount of paper from the reel; and wherein the cradling means comprises a first plurality of cusps structured and arranged to accommodate paper reels of varying sizes and the braking means comprises a plurality of brake shoes on a brake arm pivotally attached to the reel stand with each brake shoe corresponding to a cusp and with a brake piston disposed to apply each brake shoe to a corresponding mandrel.

3. The apparatus of claims 1 or 2 wherein the cradling means comprises a cradle, including first and second cradle members mounted on the reel stand, structured and arranged for supporting a reel of paper on a mandrel wherein the first cradle member includes said first plurality of cusps.

4. The apparatus of claim 3 wherein the second cradle member further includes a second plurality of cusps structured and arranged to accommodate paper reels of varying sizes.

5. The apparatus of claim 1 wherein the brake piston is disposed in a pneumatic cylinder.

6. The apparatus of claim 1 wherein the brake piston is disposed in a hydraulic cylinder.

7. The apparatus of claim 1 or 2 wherein the brake piston contains a fluid medium.

* * * * *